United States Patent [19]

Belinsky

[11] Patent Number: 4,864,958

[45] Date of Patent: Sep. 12, 1989

[54] SWAP TYPE FLOATING PLATFORMS

[76] Inventor: Sidney I. Belinsky, 40 Waterside Plaza Apt. 14-A, New York, N.Y. 10010

[21] Appl. No.: 101,285

[22] Filed: Sep. 25, 1987

[51] Int. Cl.[4] ..... B63B 43/06

[52] U.S. Cl. ..... 114/265; 114/125

[58] Field of Search ..... 114/265, 125, 61, 264, 114/121

[56] References Cited

U.S. PATENT DOCUMENTS

| | | | |
|---|---|---|---|
| 2,024,822 | 12/1935 | Hart | 114/125 |
| 3,318,275 | 5/1967 | Field | 114/125 |
| 3,537,412 | 11/1970 | Henderson | 114/125 |
| 3,580,205 | 5/1971 | Bell | 114/125 |

*Primary Examiner*—Joseph F. Peters, Jr.
*Assistant Examiner*—Edwin L. Swinehart

[57] ABSTRACT

A system for stabilizing floating semi-submersible platforms and compensating ship motion of monohull ships is based on a design protecting waterplane from vertical movement during wave actions. Each vertical strut of the semi-submersible platform utilizing this system consists of a vertical hollow column with its upper end connected to the platform upper structure and lower end open to the surrounding water. Inside the vertical hollow column is inserted a buoyancy vessel which is connected to the upper platform structure by its upper part and which serves as a means of forming a waterplane. During passive mode of this system operation, the roll and pitch of the floating platform (ship), due to wave induced forces, will be introduced because the vertical movement of the water level inside the vertical hollow column will be considerably less than the vertical movement of the water outside the vertical hollow column. During the active mode of SWAP system operation, the roll and pitch of the floating platform (ship), due to wave induced forces, or trim and list, due to the outer moment acting on the ship, will be eliminated or drastically reduced by changing the air pressure in the space between vertical hollow columns, inserted buoyancy vessel and waterline inside the vertical hollow column.

11 Claims, 8 Drawing Sheets

FIG. 1
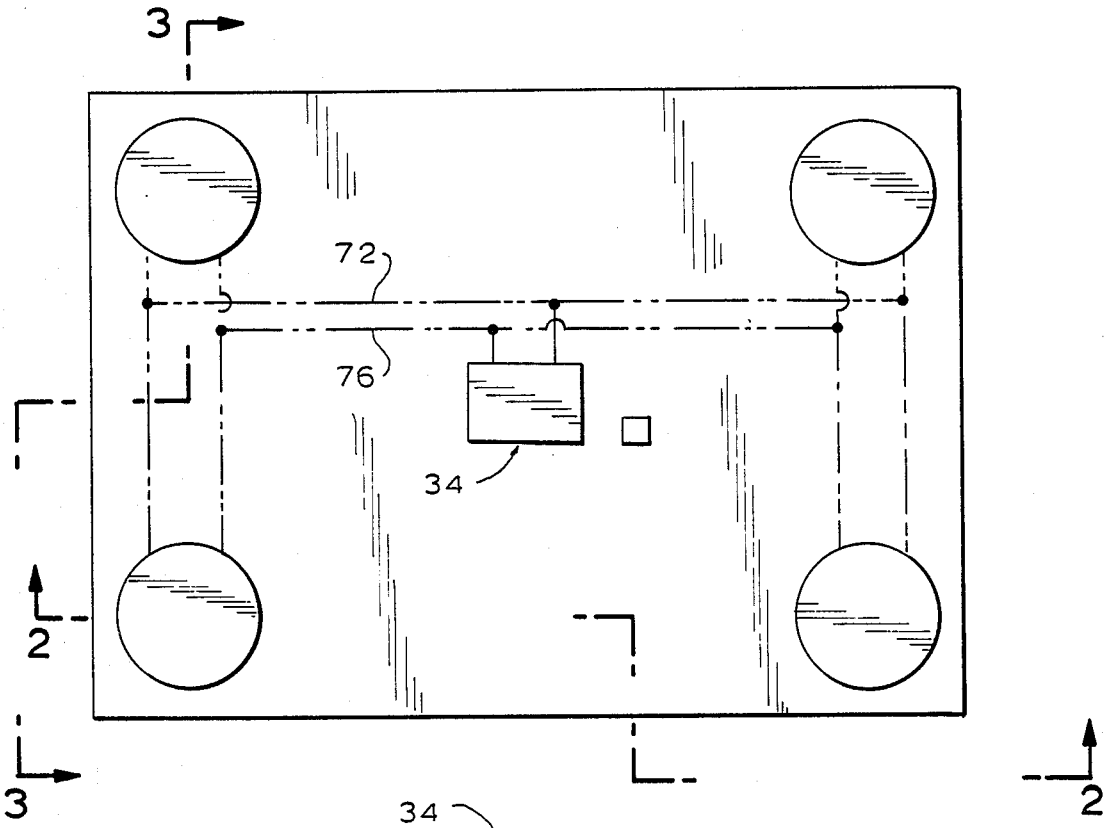
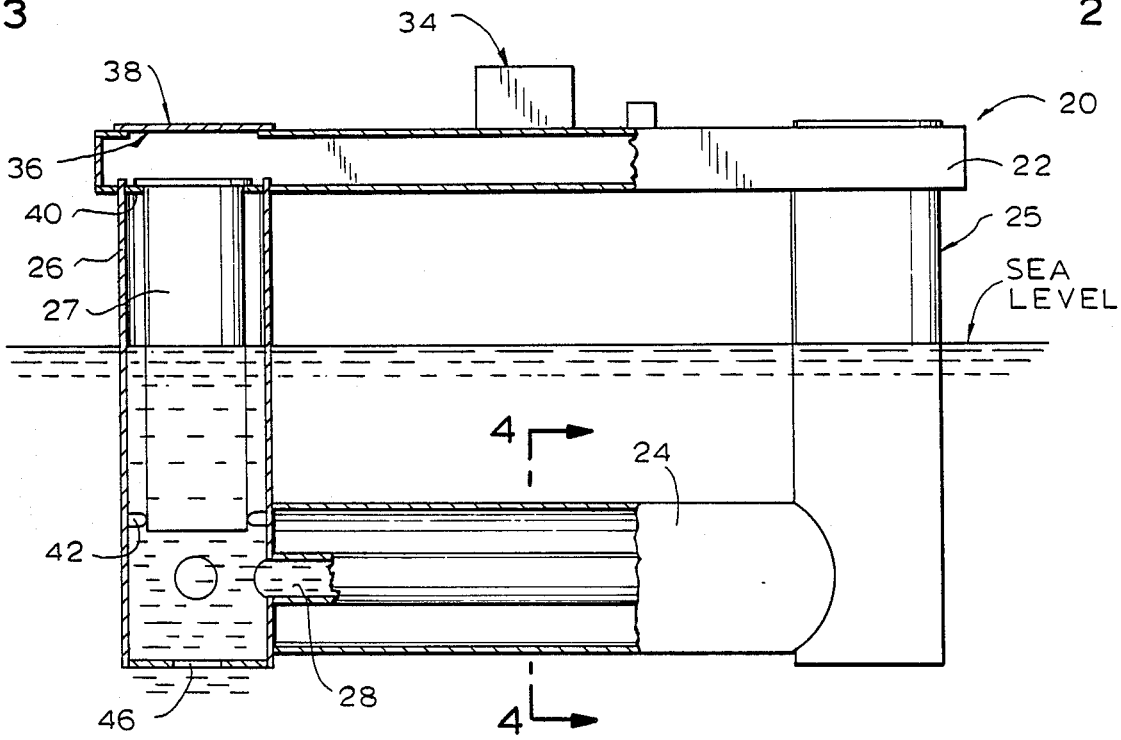
FIG. 2

SWAP TYPE FLOATING PLATFORMS (abbreviation of: Ship Waterplane Area Protected).

BACKGROUND OF THE INVENTION

This invention relates to the Marine Industry and particularly to motion stabilization of floating platforms and ships.

OBJECTIVES OF THE INVENTION

It is an object of the instant invention to improve stability of the floating platforms (ships) during the high seas and to provide them with an ability to automatically keep the platform (ship) on the even keel. Application of this invention is seen for floating drilling platforms, passenger ships, crane ships, floating terminals, SWATH-type ships, etc.

SUMMARY OF THE INVENTION

One of the SWAP type platform innovations is in the structural design that separates floating platform waterplane area from contact with the rapidly alterating waves water level of waves. This feature in a passive way significantly reduces amplitude of platform motion due to the actions of waves.

An automated active system designed to keep floating platform always on the even keel (regardless of waves or other external forces) is another innovation of the SWAP type platform.

Separation of the platform waterplane area from wave actions is achieved by locating a vertical hollow column with an open bottom and closed top around the buoyancy vessel, which forms the waterplane area. By interconnecting internal spaces of several oppositely located vertical hollow columns through water level equalizing conduits, the waterplane level inside all the hollow columns will be almost on the same level (or it will alternate equally in each of them) thus significantly reducing trim or list of the platform due to wave actions.

The automation is based on the ability to generate and control vertical forces acting in opposite directions inside the vertical hollow column, introduced to protect waterplane area from waves actions. By connecting space inside vertical hollow column with a vacuum, the downward atmospheric force acting on platform will be generated. By pumping-in compressed air inside this space, upward force acting on the platform will be generated.

By using a pair of symmetrically and oppositely located vertical hollow columns, significant restoring moment can be achieved with low pressure air (up to +0.8 bar) pumped in one and not deep vacuum (up to −0.8 bar) provided to the other.

Combination of the passive system which reduces motion generated by waves only, with active system which activates by actual platform inclination will provide floating platforms with a highly reliable motion compensation system.

Utilization of a vertical hollow column with a downward extension of a significant length will be able to significantly reduce vertical movement (heave) of the floating platform.

BRIEF DESCRIPTION OF THE DRAWINGS

FIG. 1 Plan view of a SWAP type free floating platform

FIG. 2 Elevation, Section A—A from FIG. 1
FIG. 3 Section 8—8 from FIG. 1
FIG. 4 Section C—C from FIG. 2
FIG. 5 Section D—D from FIG. 3
FIG. 6 Platform cross-section
FIG. 7 Platform cross-section through wave slope
FIG. 8 A SWAP type catamaran, Plan E—E, From FIG. 10
FIG. 9 Elevation, Section F—F, from FIG. 8
FIG. 10 Section G—G, from FIG. 8
FIG. 11 A SWAP type anchored platform
FIG. 12 A SWAP type single body ship (plan)
FIG. 13 A SWAP type single body ship (elevation)
FIG. 14 A SWAP type single body ship (section)

Referring to the drawings FIG. 1; FIG. 2.

Buoyancy vessel 32 has connecting flange 48, cylinder 50, bottom 52 and means 54 for controlling water level inside the buoyancy vessel 32. FIG. 6 illustrates System 54 which includes: submerged pump 56, outflow pipe 58 with valve 60, pump drive 62 and shaft 64. System 34 for controlling trim and list of the platform includes:

Figure 3:
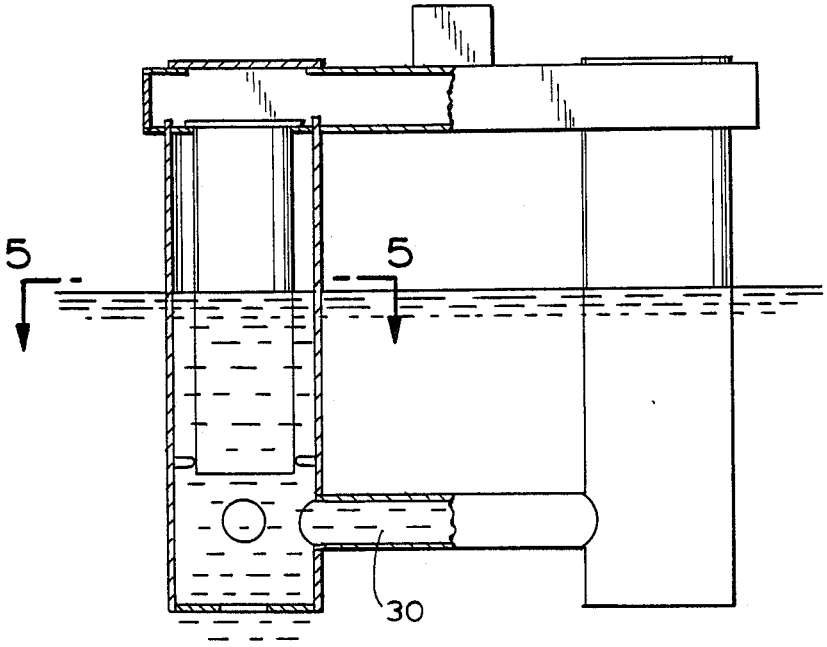
FIG. 3.

air compressor 66, compressed air tank 68, vacuum tank 70, compressed air line 72 with valves 74, vacuum line 76 with valves 78 and atmosphere pipe 80 with valve 82. Air compressor 66 on its exhaust side is interconnected with compressed air tank 68 and atmosphere through valves 84 and 86. On its suction side air compressor 66 is interconnected with vacuum tank 70 and atmosphere through valves 90 and 92. Sensor 94 indicating trim and list of the floating platform 20 is electronically interconnected with all valves of the system and with the compressor drive, thus providing the base for automating of the process of keeping floating platform on the even keel in the event of alterating outer forces acting on the platform.

Figure 7:
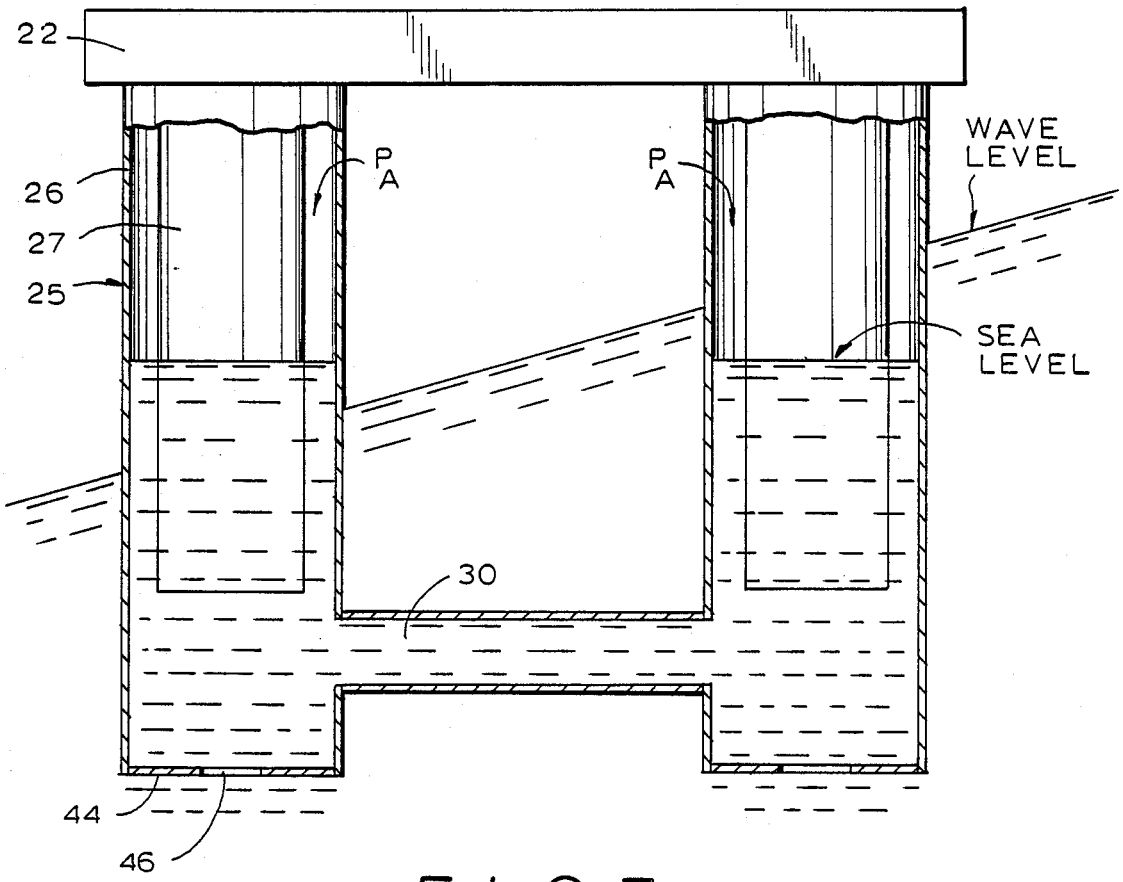
Figure 4:
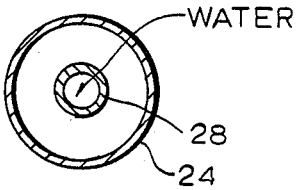
FIG. 4.
Figure 5:
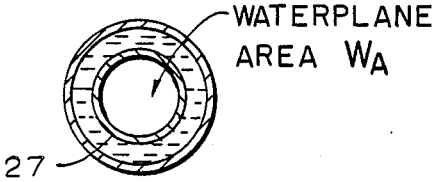
FIG. 5 and FIG. 6 the semi-submersible platform 20 includes: upper deck 22, submerged hulls 24, struts 25 containing vertical hollow column 26, and buoyancy vessel 27, horizontal water level equalizing conduits 28 and 30 interconnecting spaces of vertical hollow columns, and system 34 for controlling trim and list of the platform. Upper deck 22 has openings 36, cover 38 and ring 40 for accomodating buoyancy vessel 32. Vertical hollow column 26 has centering guides 42 and its bottom is open to surrounding water.

FIG. 7 illustrates the effect of protecting the waterplane area WA from wave action.

Figure 10:
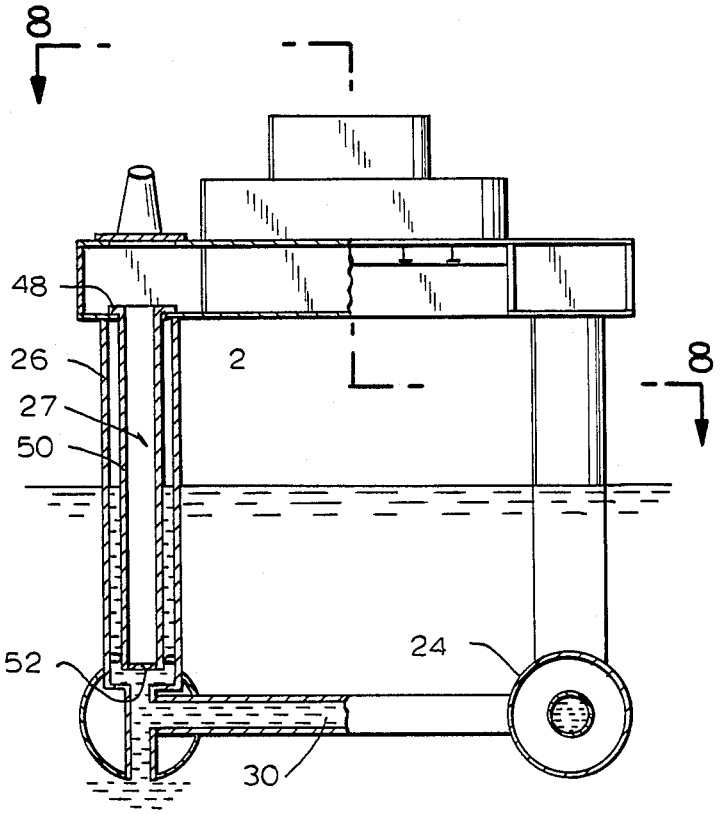
Figure 8:
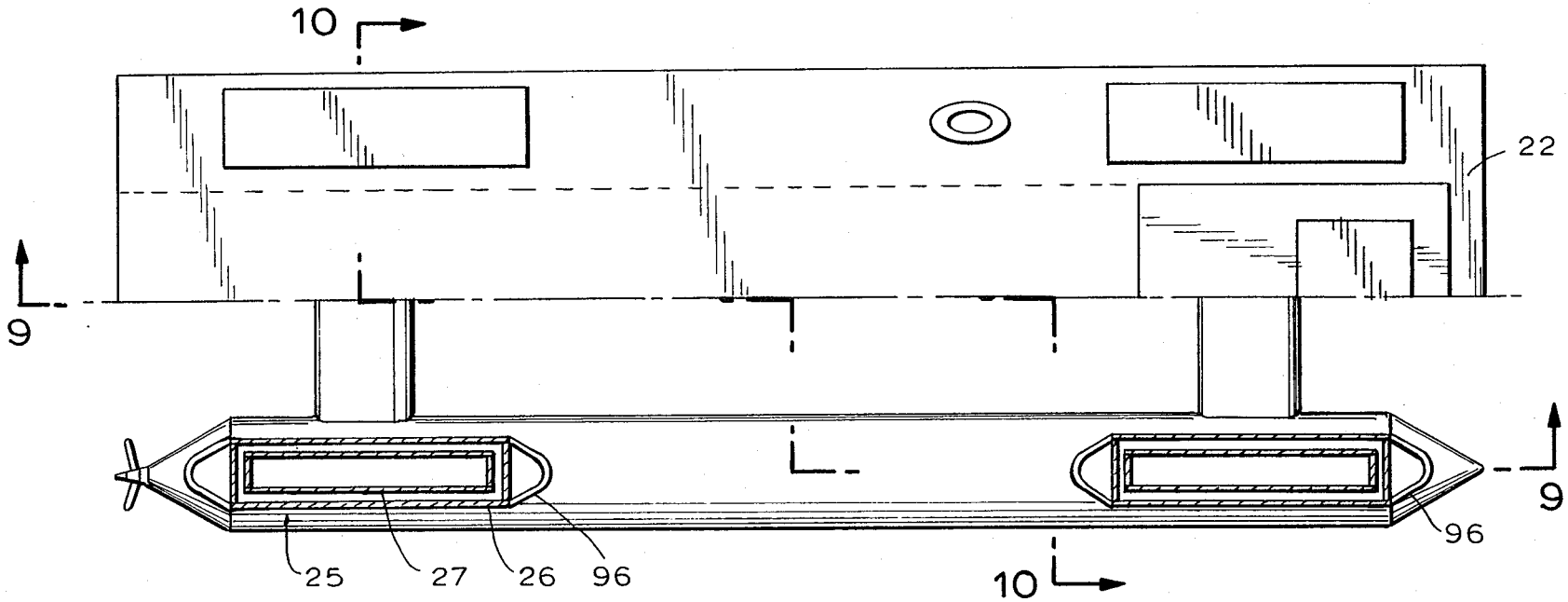
Figure 9:
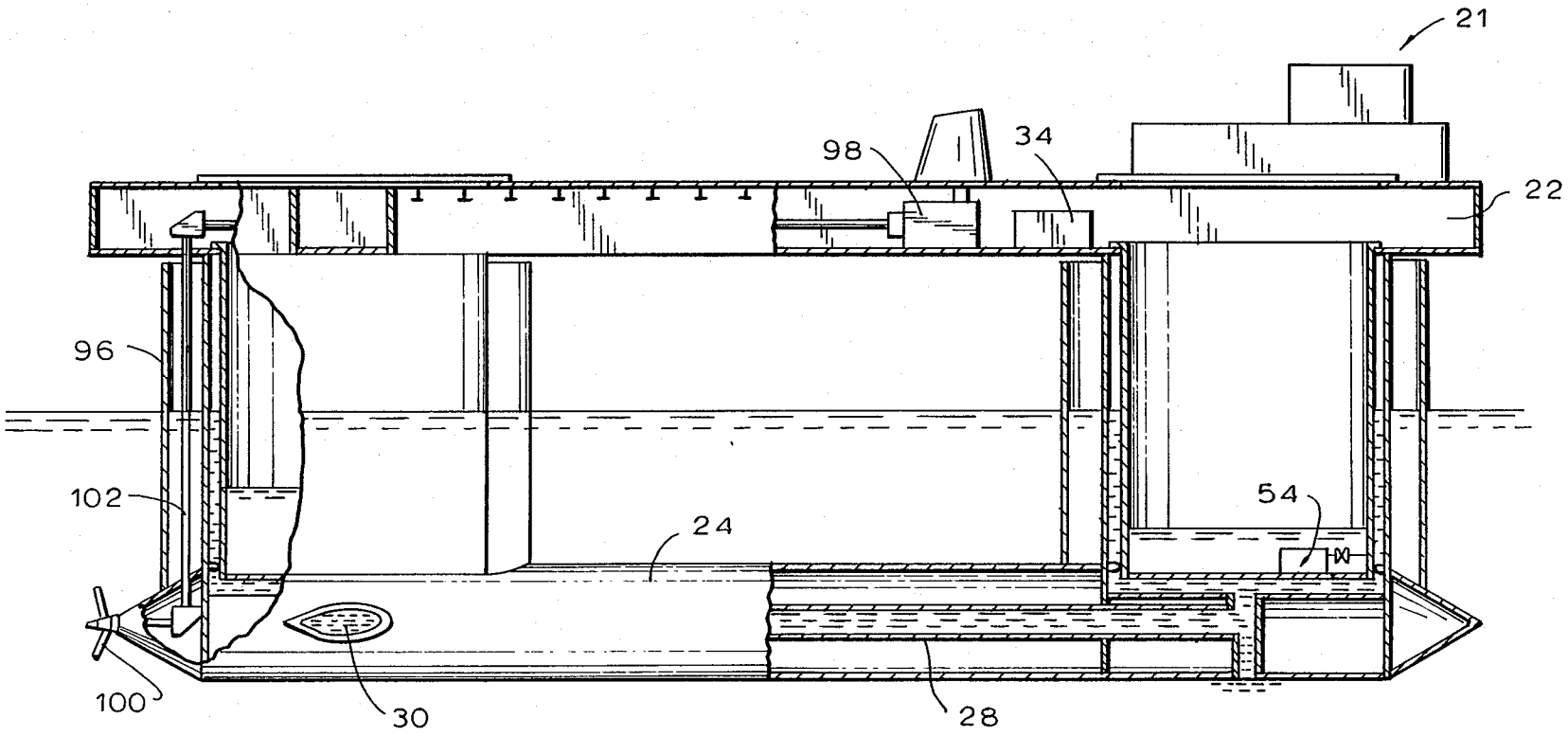

FIG. 8, FIG. 9, and FIG. 10 illustrate a catamaran-type semi-submersible self-propelled ship 21 known as SWATH—Small Waterplane Area Twin Hull—accomodating the instant invention. It includes:

Upper deck 22, submerged hulls 24, struts 25 containing vertical hollow columns 26, and buoyancy vessel 27, water level equalizing longitudinal conduit 28 and cross conduits 30. Cross conduit 30 has at its section a hydrofoil form providing additional lift force. A buoyancy vessel 27, inserted into the vertical hollow column 26, has connecting flange 48, body 50 and bottom plate 52. On the bottom plate 52 is mounted system 54 for controlling water level inside the buoyancy vessel 27, which is similar to the system of semisubmersible described earlier.

System 34, for controlling trim and list of the ship through regulating pressure (vacuum) inside the vertical columns 26, is similar to the system of semi-submersible described earlier.

Means for reducing drag of the vertical columns 26 by utilizing front and back fairings 96.

Self-propelled means including of diesel 98, propeller 100 and connecting shaft 102.

Figure 11:
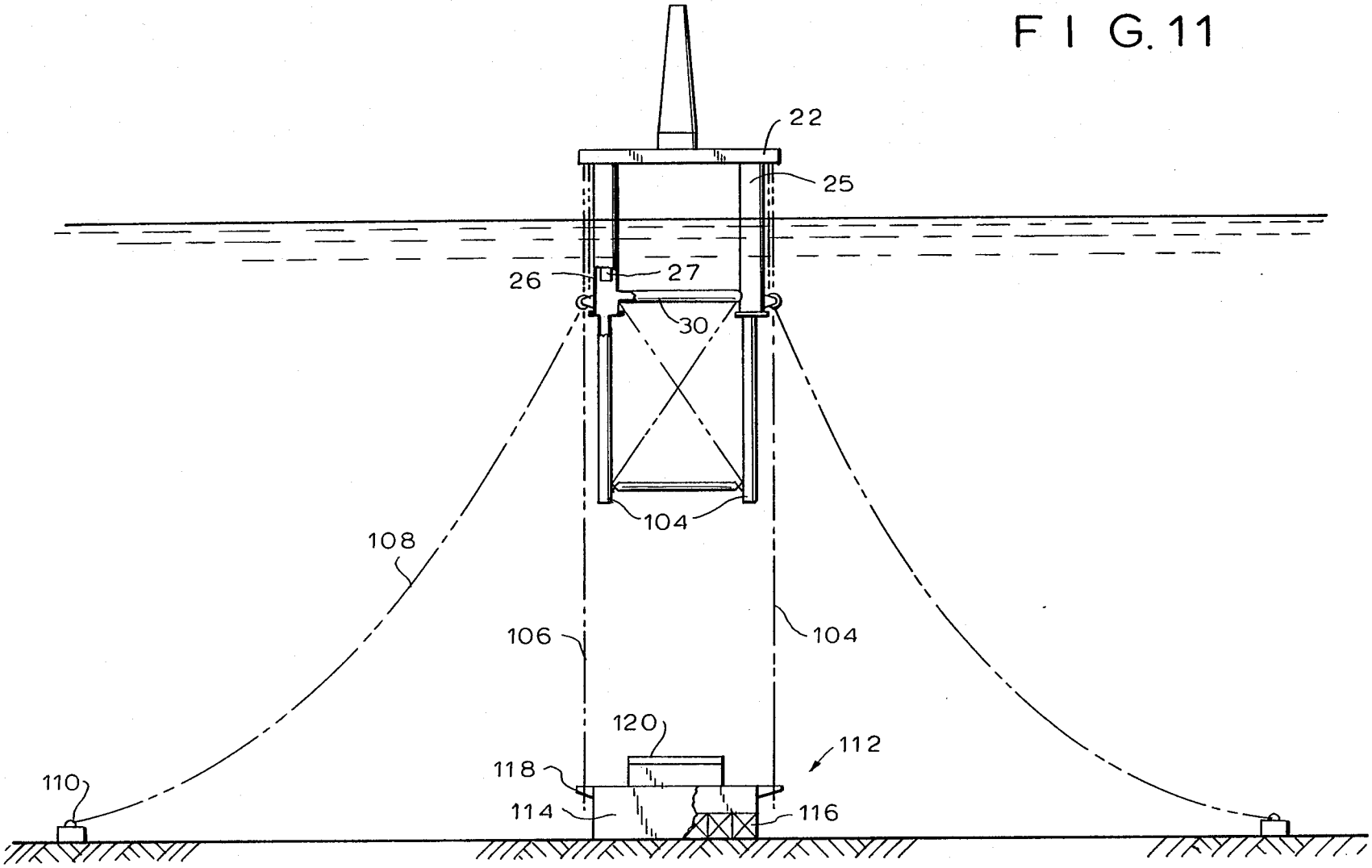

FIG. 11 illustrates a SWAP type anchored platform. This platform is of similar design as a SWAP type free floating platform described earlier. The difference is in the additional elements:

a downward extension 104 of vertical hollow column 26, tensioned anchor chains 106, a catenary mooring lines 108 and anchors 110, a foundation 112 including pontoon 114, ballast 116, anchoring arrangements 118 and well template 120.

Figure 14:
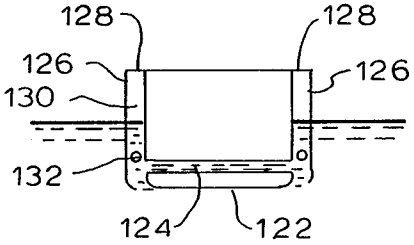
Figure 13:
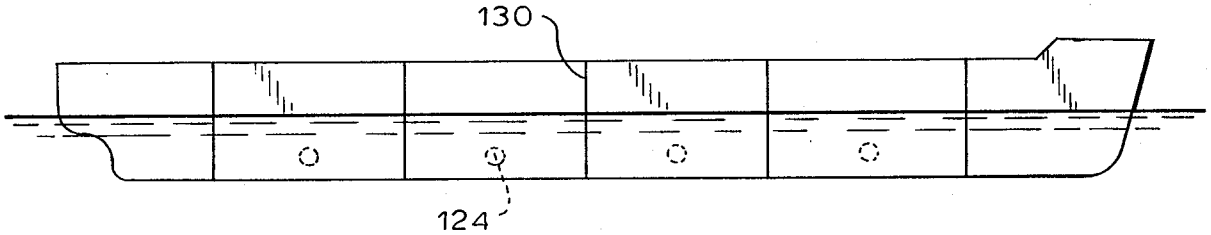
Figure 12:
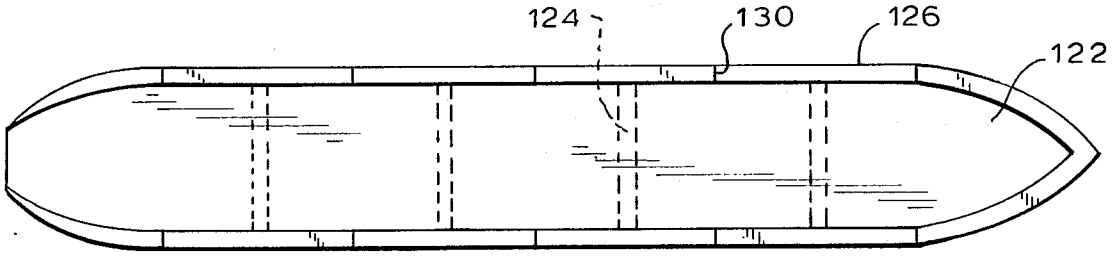

FIG. 12; FIG. 13 and FIG. 14 illustrate a SWAP type single body ship. It consists of inner hull 122 with water level equalizing conduits 124, outer hull 126, part of upper deck 128 covering space above inner and outer hulls, and partitions 130 with opening 132. It incorporates system 34 for controlling trim and list of the ship similar to the same system on the SWAP type free floating platform described earlier.

OPERATION

Figure 6:
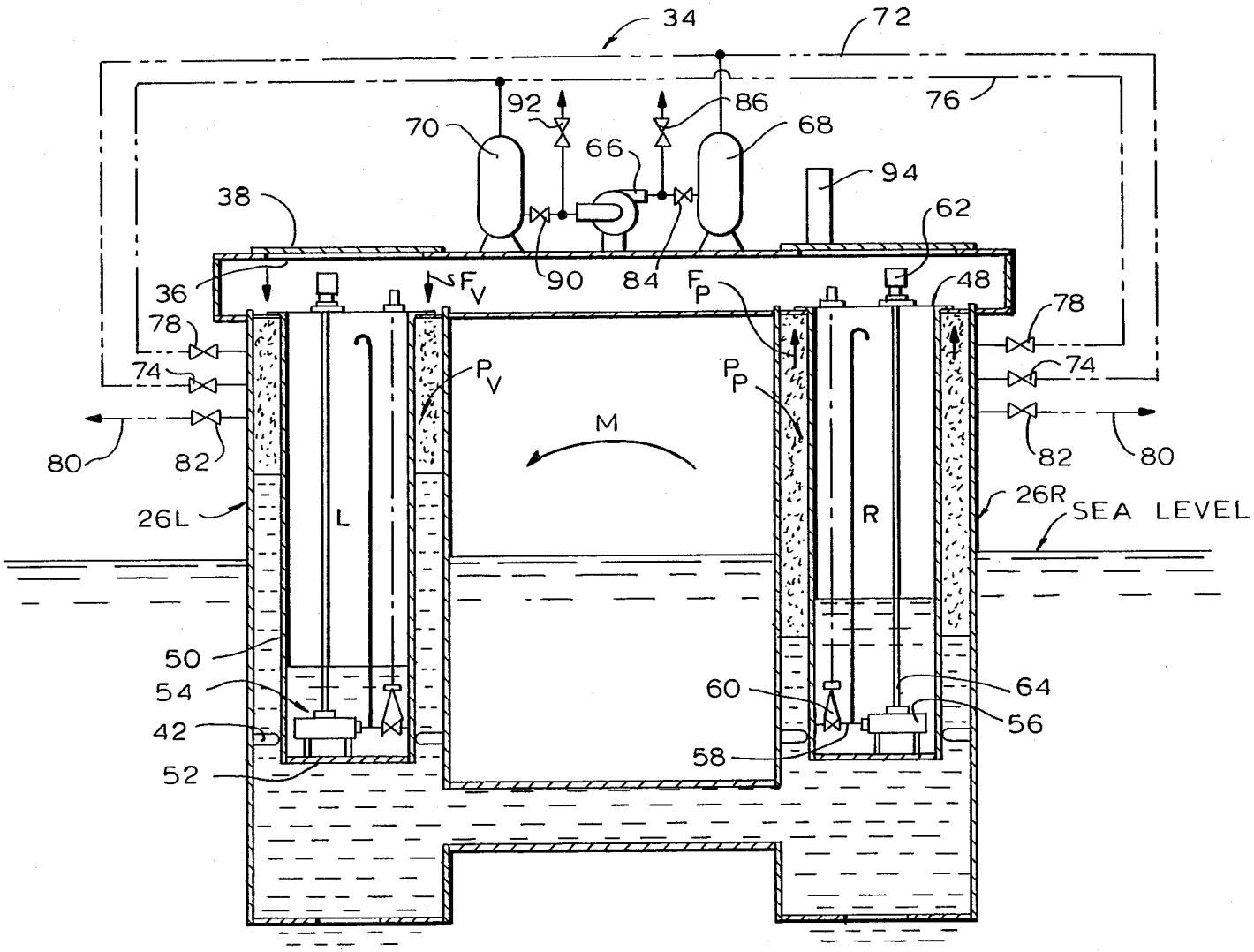

In an active mode of operation System 34, for controlling trim and list of free and anchored floating platforms, catamaran ship and single body ship, functions in the following manner:

Floating platform deviation from horizontal position (appearance of trim or list or both) triggers the sensor 94, which by remote control opens and closes certain group of valves. For example (FIG. 6) moment M tends to incline the platform (ship) to the right. This leads to signals from indicatior 94 which opens valve 78 on the left column 26L and valve 74 on the right column 26R. As the result of valve 78 opening, vacuum $P_v$ in the space between vertical hollow column 26L and inserted buoyancy vessel 27 will generate atmospheric pressure on the ring 40 and will form force $F_v$ directed downward.

As the result of valve 74 opening, excess pressure $P_p$ in the space between vertical hollow column 26R and inserted buoyancy vessel 32 will generate upward directed force $F_p$.

Forces $F_v$ and $F_p$ generate countermoment which balances the acting moment and restores the horizontal position of the platform.

I claim:

1. A ship water plane area protected free floating platform comprising:

a platform upper deck;

at least three struts, each of said struts comprising:

a vertical hollow column having a bottom end open to surrounding water and having an upper end connected to said platform upper deck;

a buoyancy vessel inserted into said vertical hollow column having a lower end closed and an upper end open to atmosphere, and a ring connecting said upper end of said buoyancy vessel to said upper end of said vertical hollow column;

a conduit located below water level connecting said vertical hollow column and said inserted buoyancy vessel of each strut to a corresponding portion of each other said strut;

and means for generating vertical forces acting on each of said rings, located between each of said buoyancy vessels and each of said vertical hollow columns to control and trim list of the floating platform.

2. The platform of claim 1 wherein each of said buoyancy vessels is connected to one of said vertical hollow columns in a manner which permits each of said buoyancy vessels to be disconnected and moved in an upward direction.

3. The platform of claim 1 wherein said means for generating forces to control trim and list of said floating platform include:

compressed air and vacuum systems which when applied into said space between said vertical hollow column and said inserted buoyancy vessel generate vertical forces on each of said rings connecting each of said hollow columns to each of said buoyancy vessels;

said compressed air and vacuum systems further comprising an air compressor, a compressed air tank, a vacuum tank, pipe lines with remote control valves connecting said space between each of said hollow columns and each of said buoyancy vessels with said compressed air tank, said vacuum tank and atmosphere;

means for indicating platform trim and list wherein said remote control valves are responsive thereto; and wherein a preselected space between each of said hollow columns and said buoyancy vessels and above an average water plane level inside each of said hollow columns to accommodate a rise of water level when vacuum is applied above said water plane level and preselected space below said average water plane level to accommodate compressed air without its escape into surrounding water when air pressure is applied above said water plane.

4. A ship water plane area protected, tied, anchored, floating platform comprising:

a platform upper deck; and at least three struts, each of said at least three three struts further comprising, a vertical hollow column having a bottom end open to surrounding water and having an upper end connected to said platform upper deck;

a downward extension of said vertical hollow column which has a flange on an upper end which is connected to said vertical hollow column;

a buoyancy vessel inserted into said vertical hollow column having a lower end closed and an upper end open; and a ring connecting said upper end of said buoyancy vessel to said upper end of said vertical hollow column;

a conduit located below water level connecting a space between said vertical hollow columns and the respective buoyancy vessel of each said strut to a similar space in each other said strut;

means for generating vertical forces, acting on said ring, located between each of said buoyancy vessels and each of said vertical hollow columns, to control the trim and list of the platform;

a foundation on the bottom of the sea including a pontoon with ballasts, an anchoring means and a well template; and catenary mooring lines from the platform to said anchoring means of said foundation.

5. A platform as set forth in claim 4 wherein said means for generating vertical forces to control trim and list of said platform comprises:

compressed air and vacuum systems which when applied into said space between each of said vertical hollow columns and each of said inserted buoyancy vessels, generates vertical forces on said rings connecting each of said hollow columns to each of said buoyancy vessels;

said compressed air and vacuum system comprising an air compressor, a compressed air tank, a vacuum tank, pipelines with remote control valves connecting said space between each of said hollow columns and each of said buoyancy vessels with said compressed air tank, said vacuum tank and atmosphere;

means for indicating platform trim and list said remote control valves being responsive thereto; and a preselected space between each of said hollow columns and each of said buoyancy vessels and above an average water plane level inside each of said hollow columns to accommodate a rise of water level, when vacuum is applied above the water plane, and a preselected space below the average water plane level to accommodate pumpedin compressed air without escape into surrounding water, when air pressure is applied above the water plane.

6. The platform of claim 4 wherein each of said buoyancy vessels is connected to each of said vertical hollow columns in a manner that permits said buoyancy vessels to be disconnected and removed in an upward direction.

7. A ship water plane area protected type catamaran comprising:

a propulsion system;

at least two submerged hulls, each of said submerged hulls comprising at least two struts interconnecting said upper deck with said submerged hull; each of said struts comprising a vertical hollow column having the form of an elongated box shaped to reduce drag and having its bottom at least partially open to the surrounding water; a buoyancy vessel inserted into said hollow column having a form of an elongated box, a lower end which is closed and an upper end open to the atmosphere and a cover plate connecting said upper end of said buoyancy vessel to an upper end of said hollow column;

cross-conduits located below water level and having a form of an elongated box shaped to reduce drag, interconnecting said hollow columns and said inserted buoyancy vessels of oppositely located struts;

longitudinal conduits located below water level and passing through said submerged hull interconnecting said hollow columns and said inserted buoyancy vessels of said struts located along one of said submerged hulls; and means for generating vertical forces acting on said cover plate located between said buoyancy vessel and said vertical hollow column to control list and trim of said catamaran.

8. The catamaran of claim 7 wherein each of said buoyancy vessels is connected to said vertical hollow columns so that each of said buoyancy vessels can be disconnected from each of said vertical hollow columns and removed in an upward direction.

9. The catamaran of claim 7 wherein said means for generating vertical forces to control trim and list of the catamaran comprise:

compressed air and vacuum systems which when applied into a space between said vertical hollow column and said inserted buoyancy vessel generate vertical forces on said cover plate connecting said hollow column and said buoyancy vessel;

wherein said compressed air and vacuum systems include an air compressor, a compressed air tank, a vacuum tank, pipelines with remote control valves, connecting space between each of said hollow columns and each of said buoyancy vessels with said compressed air tank, said vacuum tank and atmosphere;

means for indicating catamaran trim and list to which said remote control valves are responsive; and a preselected space between each of said hollow columns and each of said buoyancy vessels and above an average water plane level inside said hollow column to accommodate a rise of water level when vacuum is applied above said water plane and preselected space below said average water plane level to accommodate pumped in compressed air without its escape into surrounding water when air pressure is applied above said water plane.

10. A ship water area protected single body ship comprising:

an outer hull, including sidewalls;

an inner hull, comprising at least two water-level equalizing conduits crossing said inner hull at said inner hull's lowest part;

an upper deck;

at least two partitions dividing a space between said outer hull and said inner hull into sections, said sections being connected to each other through openings in lower portions of said partitions;

means for generating vertical forces, acting on said upper deck in an area covering said space between said inner hull and said outer hull, thereby controlling trim and list of the single body ship.

11. The ship water area protected single body ship of claim 10 wherein said vertical force generating means comprises:

compressed air and vacuum systems, which when applied to said space between said outer hull and said inner hull generate vertical forces on at least a portion of said upper deck connecting said inner hull and said outer hull;

wherein said compressed air and vacuum systems include an air compressor, a compressed air tank, vacuum tank and pipelines with remote control valves, said pipelines connecting said space between said inner hull and said outer hull with said compressed air tank, said vacuum tank and atmosphere wherein said remote valves are responsive to a means for indicating trim and list of the ship; and wherein said space between said inner hull and said outer hull is of sufficient size above an average waterplane level to accommodate a rise of water level responsive to said vacuum system and is of sufficient size below the average waterplane level to accommodate a fall in water level responsive to said compressed air system without the escape of air into surrounding waterlevel to accommodate pumped in compressed air without its escape into surrounding water when air pressure is applied above said water plane.

* * * * *